US007495190B2

(12) United States Patent
Kuhrt et al.

(10) Patent No.: US 7,495,190 B2
(45) Date of Patent: Feb. 24, 2009

(54) ELECTRICAL SWITCH

(75) Inventors: Hans-Joachim Kuhrt, Berlin (DE); Günter Seidler, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 167 days.

(21) Appl. No.: 11/528,277

(22) Filed: Sep. 28, 2006

(65) Prior Publication Data

US 2007/0075045 A1 Apr. 5, 2007

(30) Foreign Application Priority Data

Sep. 29, 2005 (DE) ..... 10 2005 047 741

(51) Int. Cl.
*H01H 33/02* (2006.01)

(52) U.S. Cl. ..... 218/149; 218/15; 218/34

(58) Field of Classification Search ..... 218/7, 218/14–22, 29, 34–36, 149, 156, 157; 335/16, 335/147, 195, 201
See application file for complete search history.

(56) References Cited

U.S. PATENT DOCUMENTS 4,764,650 A 8/1988 Bur et al.
5,969,314 A * 10/1999 Rakus et al. ..... 218/7
6,417,474 B1 * 7/2002 Rakus et al. ..... 218/148
2006/0044097 A1 3/2006 Dahl et al.

FOREIGN PATENT DOCUMENTS

DE 201 14 426 U1 2/2003
DE 102 50 950 B4 5/2004
DE 10 2004 002 932 A1 8/2005
EP 0 225 207 B1 5/1991

* cited by examiner

*Primary Examiner*—Elvin G Enad
*Assistant Examiner*—Marina Fishman
(74) *Attorney, Agent, or Firm*—Harness, Dickey & Pierce PLC

(57) ABSTRACT

An electrical switch is disclosed. The switch includes at least one switching contact which is held against the prestressing force of a contact force spring on a moving contact mount, and an arc quenching device, in which at least one section of the at least one contact force spring extends between side pieces of the contact mount. A device for limiting the spreading of combustion products is provided, which has an angle bracket inclined with respect to the opening direction of the moving contact mount. When the contact mount is in the open position, the bracket overhangs the at least one section of the at least one contact force spring. In order to protect the contact force springs, in particular at the end of the opening process, even better against contamination by spreading combustion products, the inclined angle bracket is seated in a prestressed manner on the side pieces.

18 Claims, 2 Drawing Sheets

ELECTRICAL SWITCH

PRIORITY STATEMENT

The present application hereby claims priority under 35 U.S.C. §119 on German patent application number DE 10 2005 047 741.0 filed Sep. 29, 2005, the entire contents of which is hereby incorporated herein by reference.

FIELD

The invention generally relates to an electrical switch. For example, it may relate to one having at least one switching contact which is held against the prestressing force of a contact force spring on a moving contact mount, and having an arc quenching device, in which at least one section of the at least one contact force spring extends between side pieces of the contact mount, and in which a device for limiting the spreading of combustion products is provided, which has an angle bracket, which is inclined with respect to the opening direction of the moving contact mount and, when the contact mount is in the open position, overhangs the at least one section of the at least one contact force spring.

BACKGROUND

The document DE 10 2004 002 A1 discloses an electrical switch, in which a device for limiting the spreading of combustion products is formed by a plurality of arc guide plates, so that the angle brackets are at a distance from the movement path of the free ends of the moving contacts. This refinement has the aim in particular of limiting the spreading of combustion products even during the opening process of the switching contacts.

SUMMARY

In at least one embodiment of the invention, an electrical switch is provided, in which the contact force springs are even better protected against contamination by spreading combustion products, for example at the end of the opening process.

According to at least one embodiment of the invention, the inclined angle bracket is seated in a prestressed manner on the side pieces. A refinement such as this makes it possible, by way of the inclined angle bracket, to reliably close a recess which is formed between the side pieces and is initially open in the spreading direction of an arc that is created during the opening process, when the moving switching contact is in the closed position, when the moving switching contact reaches the open position. This closure of the recess holding the contact force springs is in this case achieved without the device for limiting the spreading of combustion products having to be formed on the contact mount, which is difficult to replace from the assembly point of view, or on the moving switching contact, which is likewise difficult to replace from the assembly point of view, as is proposed by way of example in the documents EP 0 225 207 B1 or DE 201 14 426.

The prestressing force with which the angle bracket is seated on the side pieces can be provided in a simple manner by the device for limiting the spreading of combustion products being composed of a flexible, combustion-resistant material, in particular being composed of aramide.

A further example refinement of the novel electrical switch provides that the device for limiting the spreading of combustion products follows the quenching plates of the arc quenching device in the opening direction of the contact mount. In this case, the device for limiting the spreading of combustion products can advantageously be attached to an arc guide plate of the arc quenching device.

BRIEF DESCRIPTION OF THE DRAWINGS

The invention will be explained in more detail in the following text with reference to one example embodiment, which is illustrated in the drawings, in which.

DETAILED DESCRIPTION OF THE EXAMPLE EMBODIMENTS

Figure 1:
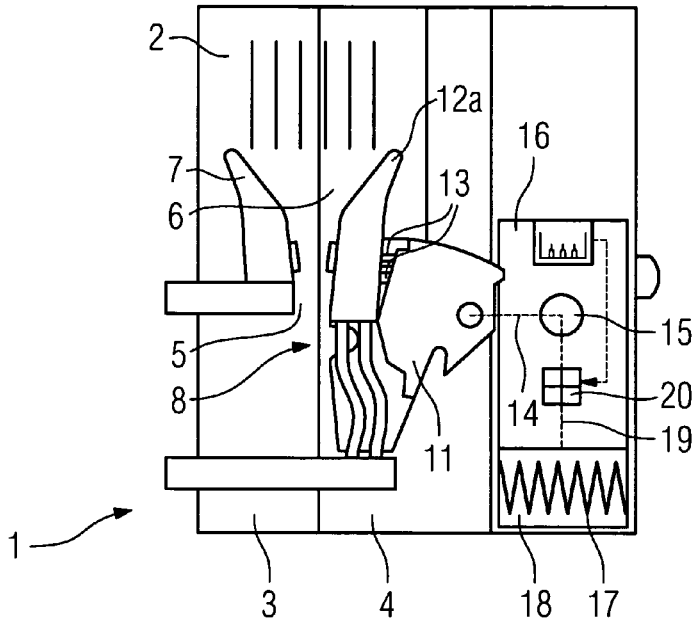
FIG. 1 shows a schematic illustration of an electrical switch.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described.

FIG. 1 shows an electrical switch 1 in the form of a low-voltage circuit breaker, which has a switching contact system, an arc quenching device 2 associated with the switching contact system, and a switching pole enclosure formed from two enclosure shells 3 and 4. The switching pole enclosure in this case forms an integrated switching chamber 5 for holding the switching contact system, and an integrated quenching chamber 6, which is open towards the switching chamber 5, for holding the arc quenching device 2.

Figure 5:
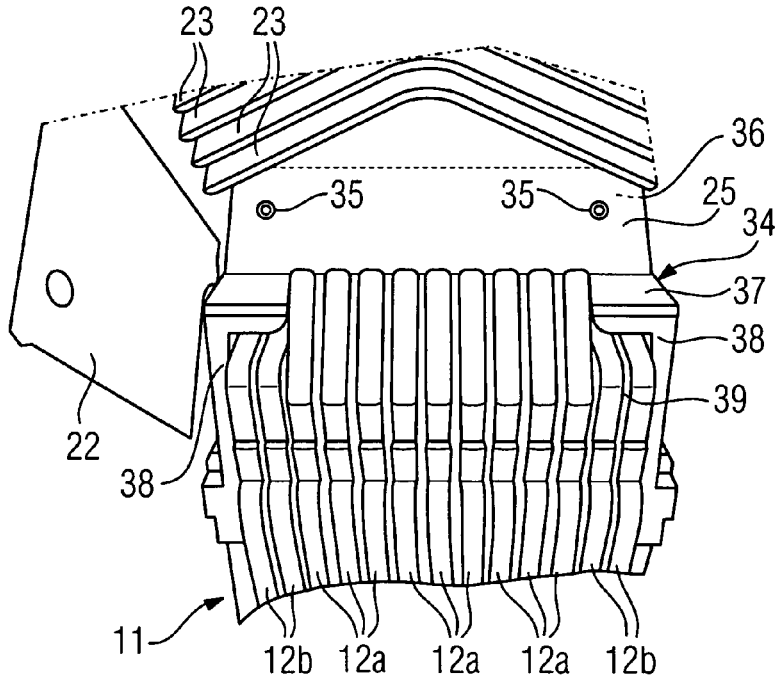
FIG. 5 shows a detail from FIGS. 2 and 3, illustrated in a perspective form.

The switching contact system includes a stationary switching contact arrangement 7 and a moving switching contact arrangement 8. The moving switching contact arrangement 8 in this case has a contact mount 11 which can pivot, and a plurality of moving switching contacts 12*a*, 12*b* in the form of contact levers (see also FIG. 5). The moving switching contacts 12*a*, 12*b* can pivot parallel to one another about a bolt which is mounted on the contact mount, and are supported in a prestressed sprung manner on the contact mount 11 by way of two contact force springs 13, in each case. The moving switching contact arrangement 7 is coupled in a known manner via a lever arrangement 14, which is only indicated schematically in FIG. 1, to a switching shaft 15.

The switching shaft 15 is at the same time used to drive further switching contact systems, which are not illustrated any further but are arranged parallel to the illustrated switching contact system, and each of which has a further associated arc quenching device, which is likewise not illustrated. The switching shaft 15 can be moved by way of a drive apparatus 16 from an off position, in which the switching contact systems are open, to an on position, in which the switching contact systems are closed. When the switching shaft 15 is being moved to its on position, the contact force springs 13 are stressed further. The drive apparatus 16 has a drive 18 provided with a storage spring 17, a drive rod 19 which couples the drive 18 to the switching shaft 15, and a switching mechanism 20.

According to FIGS. 2 to 5, each of the arc quenching devices 2 includes two isolating walls 22 composed of fiber or combustion-resistant plastic, as well as arc quenching plates 23 and arc guide plates 24, 25. The arc quenching plates 23 and the arc guide plates 24, 25 are provided with pins 26, which are inserted into holes 27 in the insulating walls 22, and are peened over. This results in an arc splitter stack, which is inserted into the quenching chamber 6. The arc quenching device also has a cover 28 which closes it and is provided with blow-out slots 29, side formed areas 30 and an aperture opening 31. The side formed areas 30 engage in slots 33 in the insulating walls 22, in order to attach the cover 28 to the arc splitter stack. An attachment screw which is not illustrated is used for mounting the arc quenching device 2 in the quenching chamber 6 and, passing through the aperture opening 31, engages in a threaded hole, associated with it, in one of the two enclosure shells 3 of the switching pole enclosure.

Figure 2:
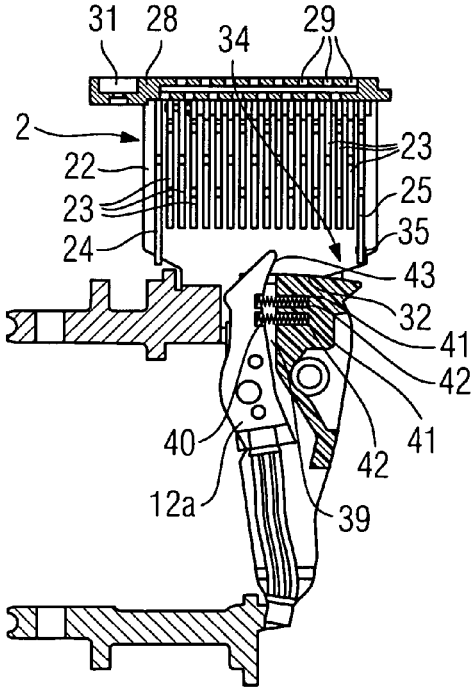
FIGS. 2 and 3 show an arc quenching device, which is arranged above a closed switching contact system and is provided with a means for limiting the spreading of combustion products.
Figure 3:
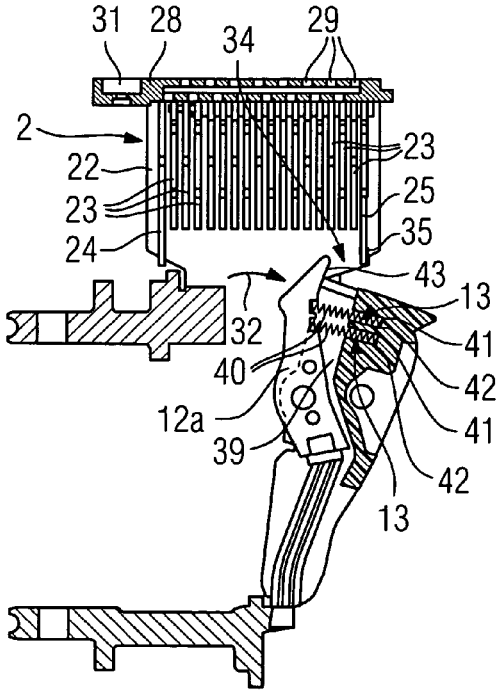
Figure 4:
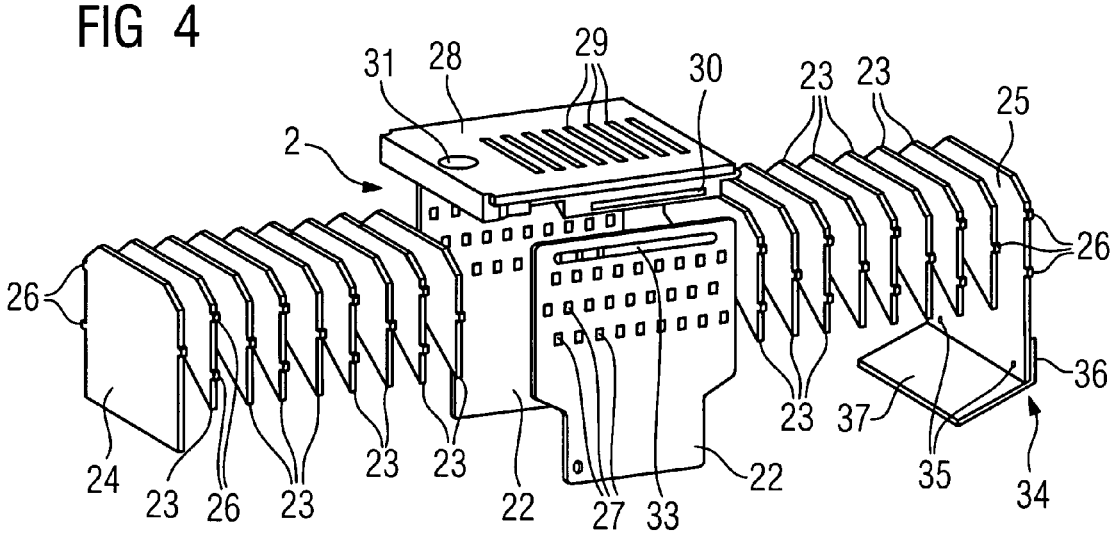
FIG. 4 shows the arc quenching device as shown in FIGS. 2 and 3, illustrated in an exploded form.

As can be seen from FIGS. 2 and 3, the stationary switching contact arrangement 7 is associated with the flat arc guide plate 24, which forms an outer face of the arc splitter stack, running at right angles to the insulating plates 22. The moving switching contact arrangement 8 is associated with the arc guide plate 25, which likewise forms an outer face of the arc splitter stack running at right angles to the insulating plates. The arc quenching plates 23 and the arc guide plates 24 and 25 are composed of sheet steel.

A device, which is located downstream from the arc guide plate 25 in the opening direction 32 of the moving contact mount 11, for limiting the spreading of combustion products 34 is attached via screw joints or riveted joints 35 to that face of the arc guide plate 25 which faces in the opening direction 32.

In one example embodiment, the device for limiting the spreading of combustion products 34 has a first part 36, which runs parallel to the arc quenching plates 23 and the arc guide plates 24, 25, and has an angle bracket 37 which is inclined with respect to the opening direction 32 of the moving switching contacts 12*a*, 12*b*.

The free end of the angle bracket 37 is seated on side pieces 38 of the contact mount 11 which can pivot, and thus ensures optimum closure of a recess 39 which is formed between the side pieces 38. A first section 40 of the contact force springs 13 runs in this recess 39, while a second section 41 of the contact force springs 13 runs in holes 42 in the contact mount 11.

The angle bracket 37 is designed in such a manner that it closes the recess between the side pieces at the time at which the moving contact mount 11 and thus also the moving switching contacts 12*a*, 12*b* are in their open position, in the form of a roof, as far as the rear face 43 of the moving switching contacts 12*a*, 12*b*. This prevents switching gases and combustion residues from flowing into the recess 39 that is formed between the side pieces, and thus prevents the risks of deposits on the contact force springs 13. Trials have shown that this reliably prevents on-switching/through-switching failure of the electrical switch as a result of the contact force springs 13 becoming blocked.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electrical switch, comprising:

at least one switching contact, held against a prestressing force of at least one contact force spring on a moving contact mount, at least one section of the at least one contact force spring extending between side pieces of the contact mount;

an arc quenching device including at least one arc guide plate; and means for limiting spreading of combustion products, including an angle bracket extending from the at least one arc guide plate,the angle bracket being inclined with respect to an opening direction of the moving contact mount and, when the contact mount is in an open position, which overhangs the at least one section of the at least one contact force spring, the inclined angle bracket being in contact with the at least one switching contact and the side pieces.

2. The electrical switch as claimed in claim 1, wherein the means for limiting the spreading of combustion products is composed of a flexible, combustion-resistant material.

3. The electrical switch as claimed in claim 2, wherein the means for limiting the spreading of combustion products is composed of aramide.

4. The electrical switch as claimed in claim 1, wherein the means for limiting the spreading of combustion products follows quenching plates of the arc quenching device in the opening direction of the moving contact mount.

5. The electrical switch as claimed in claim 1, wherein the means for limiting the spreading of combustion products is attached to the at least one arc guide plate of the arc quenching device.

6. The electrical switch as claimed in claim 2, wherein the means for limiting the spreading of combustion products follows quenching plates of the arc quenching device in the opening direction of the moving contact mount.

7. The electrical switch as claimed in claim 3, wherein the means for limiting the spreading of combustion products follows quenching plates of the arc quenching device in the opening direction of the moving contact mount.

8. The electrical switch as claimed in claim 2, wherein the means for limiting the spreading of combustion products is attached to the at least one arc guide plate of the arc quenching device.

9. The electrical switch as claimed in claim 3, wherein the means for limiting the spreading of combustion products is attached to the at least one arc guide plate of the arc quenching device.

10. The electrical switch as claimed in claim 4, wherein the means for limiting the spreading of combustion products is attached to the at least one arc guide plate of the arc quenching device.

11. The electrical switch as claimed in claim 6, wherein the means for limiting the spreading of combustion products is attached to the at least one arc guide plate of the arc quenching device.

12. The electrical switch as claimed in claim 7, wherein the means for limiting the spreading of combustion products is attached to the at least one arc guide plate of the arc quenching device.

13. An electrical switch, comprising:

at least one switching contact, held against a prestressing force of at least one contact force spring on a moving contact mount, at least one section of the at least one contact force spring extending between side pieces of the contact mount;

an arc quenching device including at least one arc guide plate; and an angle bracket, extending from the at least one arc guide plate, inclined with respect to an opening direction of the moving contact mount which, when the contact mount is in an open position, overhangs the at least one section of the at least one contact force spring, the inclined angle bracket being in contact with the at least one switching contact and the side pieces.

14. An electrical switch, comprising:

at least one switching contact, held against a prestressing force of at least one contact force spring on a moving contact mount, at least one section of the at least one contact force spring extending between side pieces of the contact mount;

an arc quenching device including at least one arc guide plate; and a device to limit spreading of combustion products, including an angle bracket extending from the at least one arc guide plate, the angle bracket being inclined with respect to an opening direction of the moving contact mount and, when the contact mount is in an open position, which overhangs the at least one section of the at least one contact force spring, the inclined angle bracket being in contact with the at least on switching contact and the side pieces.

15. The electrical switch as claimed in claim 14, wherein the device to limit the spreading of combustion products is composed of a flexible, combustion-resistant material.

16. The electrical switch as claimed in claim 15, wherein the device to limit the spreading of combustion products is composed of aramide.

17. The electrical switch as claimed in claim 14, wherein the device to limit the spreading of combustion products follows quenching plates of the arc quenching device in the opening direction of the moving contact mount.

18. The electrical switch as claimed in claim 14, wherein the device to limit the spreading of combustion products is attached to the at least one arc guide plate of the arc quenching device.

* * * * *